US010239586B1

(12) United States Patent
Harbaugh

(10) Patent No.: US 10,239,586 B1
(45) Date of Patent: Mar. 26, 2019

(54) POOL NOODLE WITH DRINK HOLDER

(71) Applicant: Kenneth A. Harbaugh, Villa Rica, GA (US)

(72) Inventor: Kenneth A. Harbaugh, Villa Rica, GA (US)

( * ) Notice: Subject to any disclaimer, the term of this patent is extended or adjusted under 35 U.S.C. 154(b) by 0 days.

(21) Appl. No.: 15/715,103

(22) Filed: Sep. 25, 2017

(51) Int. Cl.
*B63B 35/73* (2006.01)
*B63B 25/00* (2006.01)

(52) U.S. Cl.
CPC ..... *B63B 25/004* (2013.01); *B63B 35/73* (2013.01)

(58) Field of Classification Search
CPC ..... B63B 25/004; B63B 35/73
See application file for complete search history.

(56) References Cited

U.S. PATENT DOCUMENTS 6,790,112 B2 * 9/2004 Kirk ..... A47G 23/0216 220/739
2011/0233092 A1 * 9/2011 Slattery ..... B65D 1/36 206/427
2015/0289690 A1 * 10/2015 Parker ..... A45F 3/16 220/560

* cited by examiner

*Primary Examiner* — Stephen P Avila
(74) *Attorney, Agent, or Firm* — Larry A. Roberts

(57) ABSTRACT

A pool toy consists of a flexible, buoyant pool noodle with a drink holder mounted to one end. A user sits on or astride the noodle in a well-known manner to float relaxingly in a generally upright posture in a pool, lake, or other body of water. The weight of the user on the flexible noodle causes the noodle to bend into a substantially U-shaped configuration, in which at least one end of the pool noodle projects above the surface of the water. The drink holder is mounted to an end of the pool noodle that is located above the surface of the water, providing a handy location to hold a beverage container.

9 Claims, 4 Drawing Sheets

POOL NOODLE WITH DRINK HOLDER

BACKGROUND OF THE INVENTION

Technical Field

The present invention relates generally to pool toys. More specifically, a drink holder fits onto the end of a pool noodle and holds a cup, beverage can, tumbler, or other drink container for convenient access by the user while riding the pool noodle.

Background Art

The pool noodle is a well-known pool toy. The pool noodle is an elongated, cylindrical length of polyethylene foam, often hollow. The pool noodle is buoyant and flexible. Dimensions of a typical pool noodle may be about 160 cm. (63 in.) in length and about 7 cm. (2.8 in.) in diameter.

A common use of a pool noodle is for the user to sit on or astride the buoyant noodle to float relaxingly in a generally upright posture in a swimming pool, lake, or other recreational body of water. (As used herein, when a user sits "on" a pool noodle, both legs are on the same side of the noodle; and when a user sits "astride" a pool noodle, the legs are on opposite sides of the noodle. When a user "rides" a pool noodle, the user can be sitting either on or astride the noodle.) When riding a pool noodle, the user often desires to keep a beverage within easy reach.

BRIEF SUMMARY OF THE INVENTION

The invention relates generally to a pool toy comprising a flexible, buoyant pool noodle with a drink holder mounted to one end. A user sits on or astride the noodle in a well-known manner to float relaxingly in a generally upright posture in a pool, lake, or other body of water. The weight of the user on the flexible noodle causes the noodle to bend into a substantially U-shaped configuration, in which at least one end of the pool noodle projects above the surface of the water. The pool noodle is arranged so that the drink holder is mounted to an end of the pool noodle that is located above the surface of the water.

The drink holder has an inner wall defining a diameter that is larger than most common drink containers, such as drink cans, cups, and thermally insulated tumblers. Ridges project radially inward from the inner wall of the drink holder. When the user places a drink container in the drink holder, the ridges deform, compress, or are crushed to conform to the diameter of the drink container and create a snug fit.

DETAILED DESCRIPTION OF THE INVENTION

Figure 1:
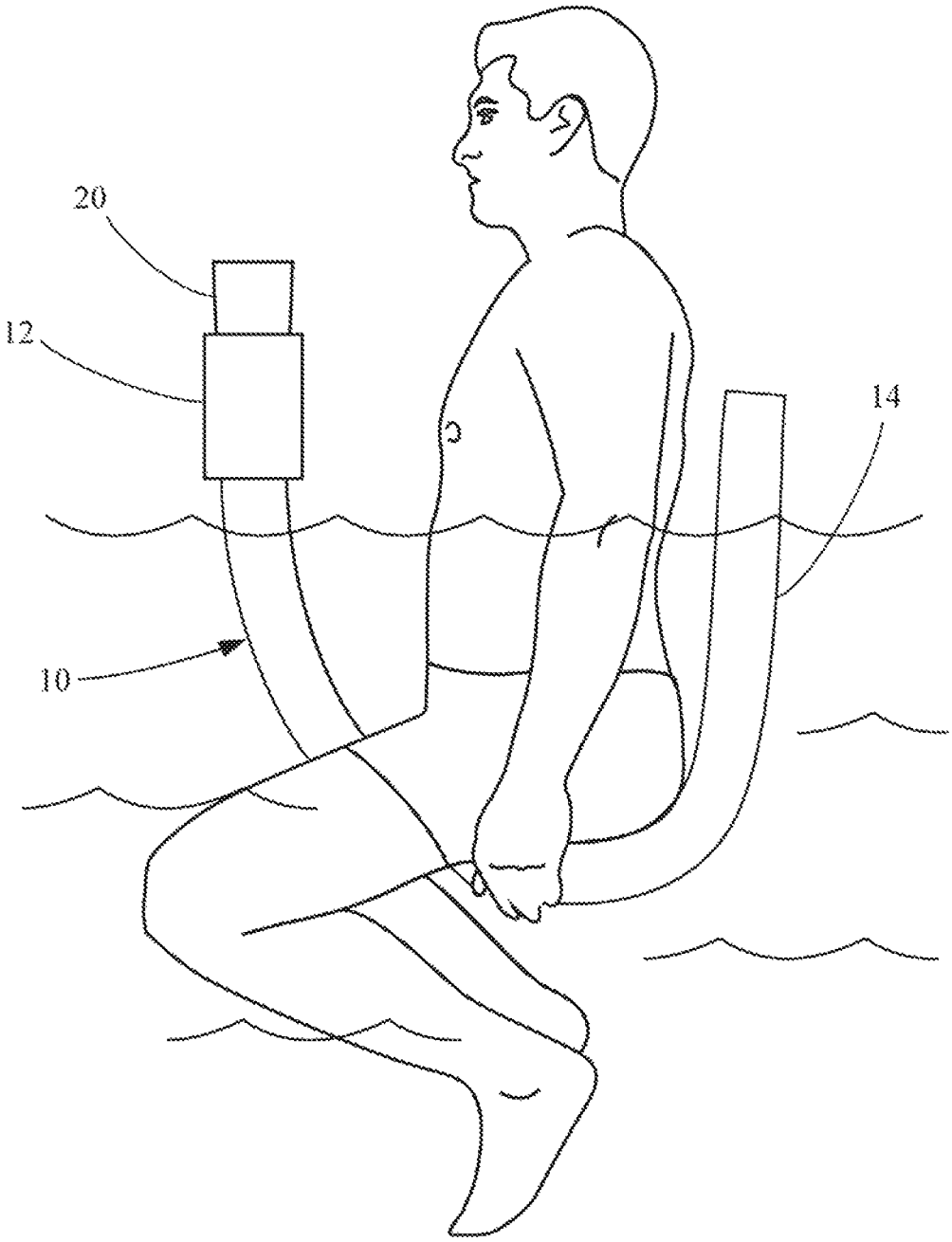
FIG. 1 is a side view showing a user riding a pool noodle, with a drink holder mounted to one end of the noodle to hold a beverage container.

Referring now to the drawings, in which like numerals indicate like elements throughout the several views, FIG. 1 illustrates a drink holder and pool noodle combination 10 comprising a drink holder 12 mounted to an end of a conventional pool noodle 14. A user sits on or astride the buoyant pool noodle 14 in a generally upright position to float relaxingly in a pool, lake, or other body of water.

With the user sitting on or astride the flexible pool noodle 14, as shown in FIG. 1, the pool noodle bends around the body of the user to form a generally U-shaped configuration in which the ends of the pool noodle are located above the surface of the water. The drink holder 12 mounted to the end of the pool noodle 14 is thus also disposed above the surface of the water.

Figure 2:
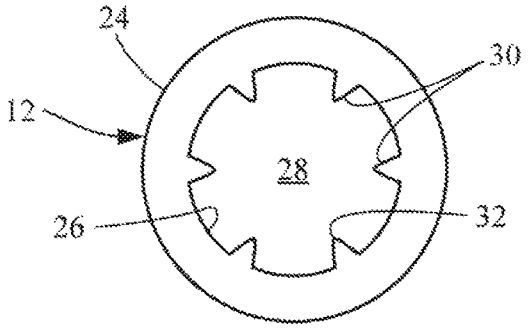
FIG. 2 is a top view of the drink holder of FIG. 1.
Figure 3:
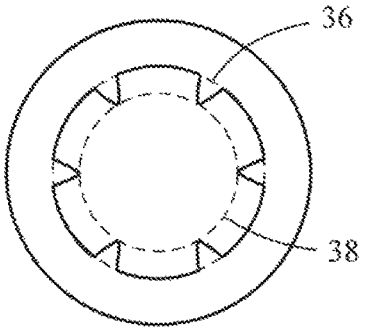
FIG. 3 is a second top view of the drink holder of FIG. 1.
Figure 4:
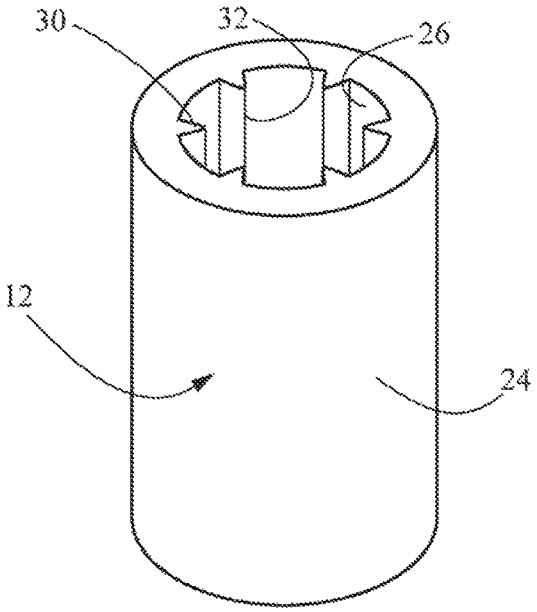
FIG. 4 is an isometric view of the drink holder of FIG. 1.

FIGS. 2-4 illustrate details of the drink holder 12. The drink holder 12 is a hollow tube having an outer wall 24 and an inner wall 26 defining a central opening 28. A plurality of ridges 30 extend radially inward from the inner wall 26. Each ridge 30 has an innermost end or tip 32. The inner wall and ridges form two diameters—a first, large inner diameter 34 defined by the inner wall 26, and a second, small inner diameter 36 defined by the inner ends 32 of the ridges 30. (For an even number of evenly spaced ridges 30, the smaller inner diameter 36 is simply the distance between the tips 32 of opposing ridges.)

The drink holder 12 is optionally extruded from the same flexible, foamed polyethylene material from which the pool noodle 14 is manufactured. The drink holder 12 of the disclosed embodiment is about 7.5 inches high and has an outer diameter of about 4.5 inches. The drink holder 12 has a large inner diameter 34 defined by the inner wall 26 of from 2.75 to 4.0 in., and preferably approximately 3.0 inches. The drink holder 12 has a small inner diameter 36 defined by the tips 32 of the ridges 30 of from 2.0 inches to 2.75 inches, and preferably approximately 2.5 inches.

In a disclosed embodiment, each ridge 30 is 0.1 to 0.5 inches from base to tip and preferably 0.25 inches from base to tip.

Figure 5:
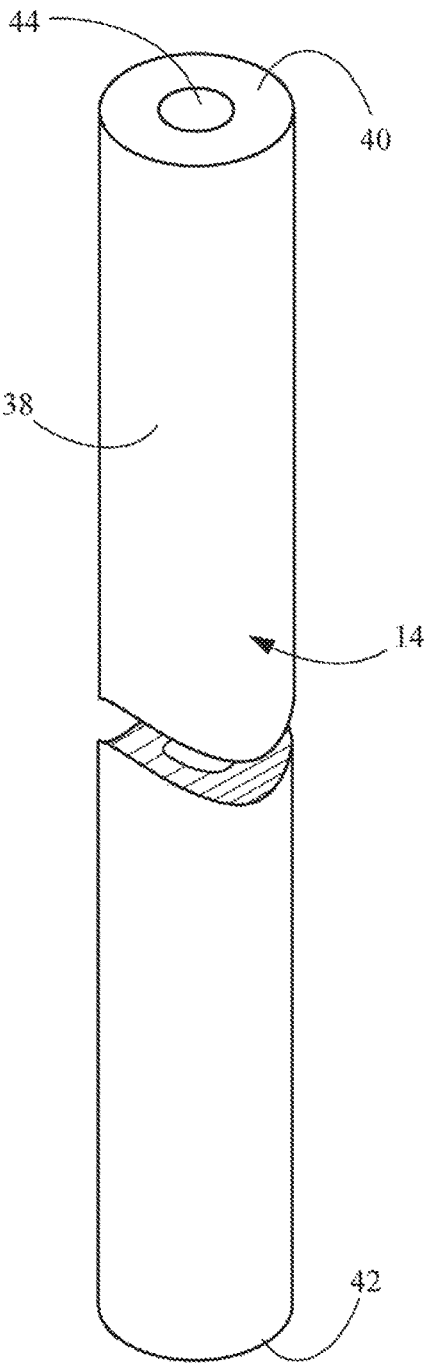
FIG. 5 is an isometric view of a pool noodle.

FIG. 5 depicts the pool noodle 14. The noodle 14 is formed from extruded polyethylene foam and is generally tubular in shape. The noodle 14 has a side wall 38, first and second ends 40, 42 and, optionally, a central longitudinal opening 44. The pool noodle 14 of the disclosed embodiment is approximately 63 inches in length and has a cross-sectional diameter of about 2.8 inches, dimensions that are disclosed only by way of example.

Figure 6:
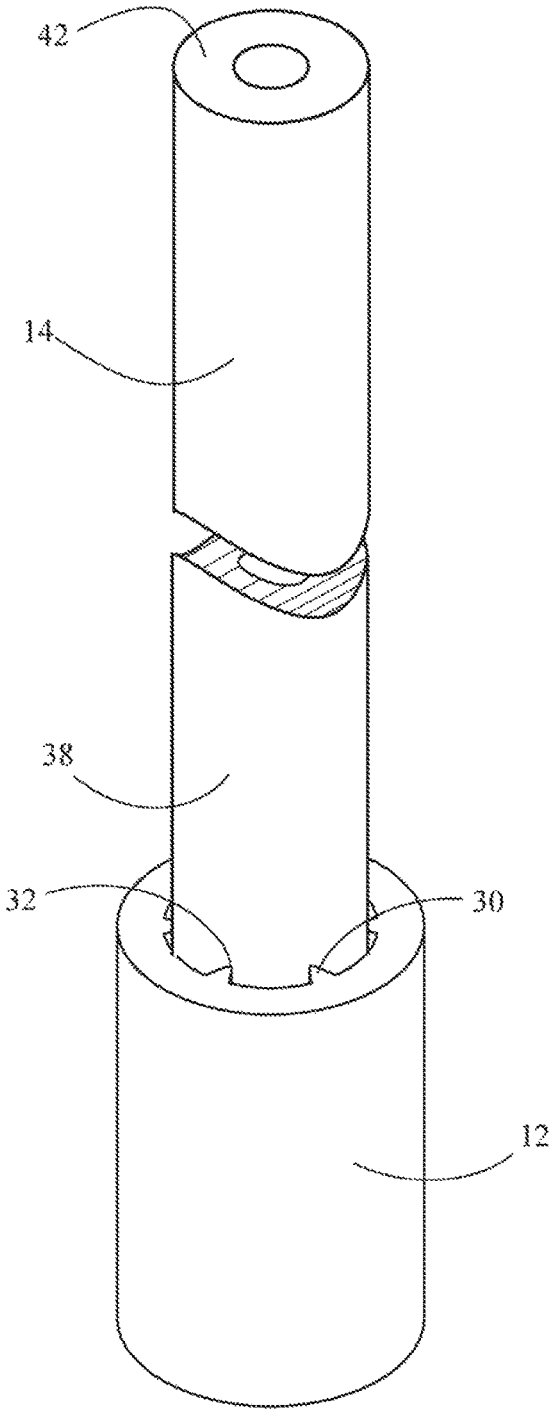
FIG. 6 is a bottom isometric view of the drink holder of FIG. 1 mounted to an end of the pool noodle of FIG. 5.

FIG. 6 illustrates the coupling of the drink holder 12 to the pool noodle 14. The end 40 of the pool noodle 14 (not visible in FIG. 6 but opposite end 42 of the noodle) is inserted into an end of the drink holder 12. Depending on the relative hardnesses of the polyethylene compositions from which the drink holder 12 and noodle 14 are formed, the sharpness of the tips 32 of the ridges 30, the number of ridges, and other factors, the ridges may bite into the side wall 38 of the noodle or might be crushed or deformed to create a tight fit between the drink holder 12 and the end of the noodle 14.

In the disclosed embodiment, the end of the noodle fits approximately 3.0 inches into the opening of the drink holder 12.

For the drink holder 12 to be securely coupled to the end of the noodle 14, the diameter of the noodle must be less than or equal to the large inner diameter 34 defined by the inner wall 26 of the drink holder, so that the end of the noodle can fit into the central opening 22 of the drink holder. Further, the diameter of the pool noodle 14 must be greater than or equal to the small inner diameter 36 defined by the tips 32 of the ridges 30, so that the side wall of the pool noodle will deform, compress, or crush the ridges 30 to create the interference fit between the drink holder 12 and the pool noodle 14.

Figure 7:
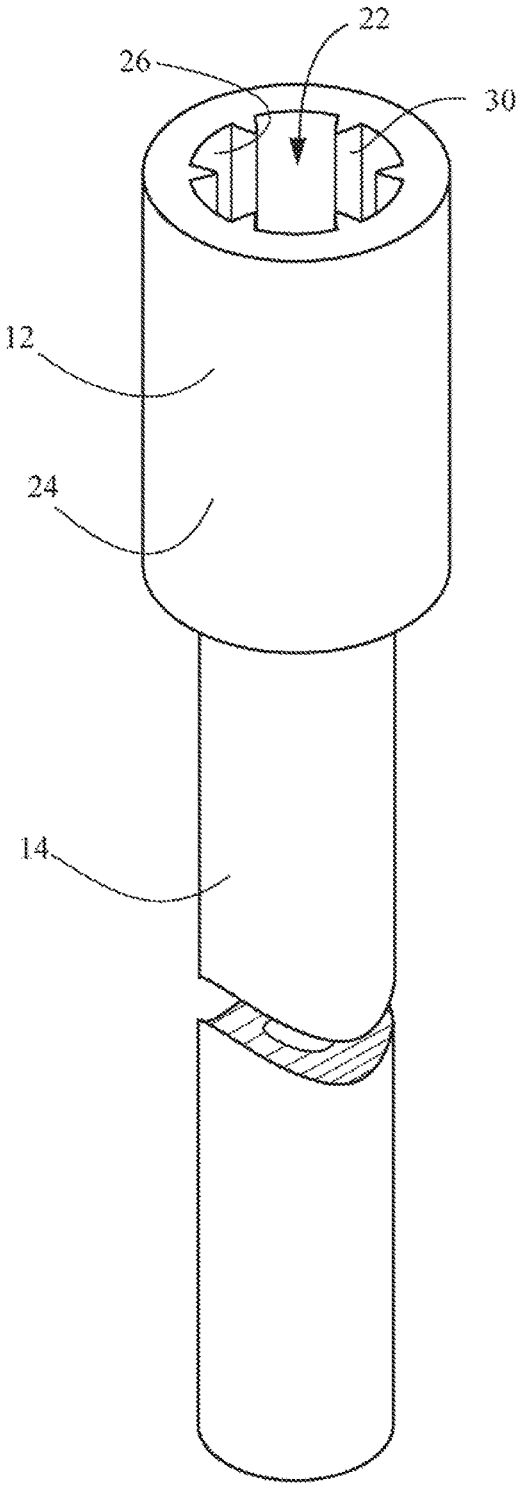
FIG. 7 is a top isometric view of the drink holder and pool noodle combination of FIG. 6.

FIG. 7 shows the upper or open end of the drink holder 12, with opposite end of the drink holder mounted to the noodle 14. The ridges 30 extend radially inward from the interior wall 26 of the central opening 22 of the drink holder 12. In the disclosed embodiment, the opening 22 is closed by the upper end 40 of the noodle 14 at a location spaced downward by about 4.0-4.5 inches from the open end of the drink holder.

Figure 8:
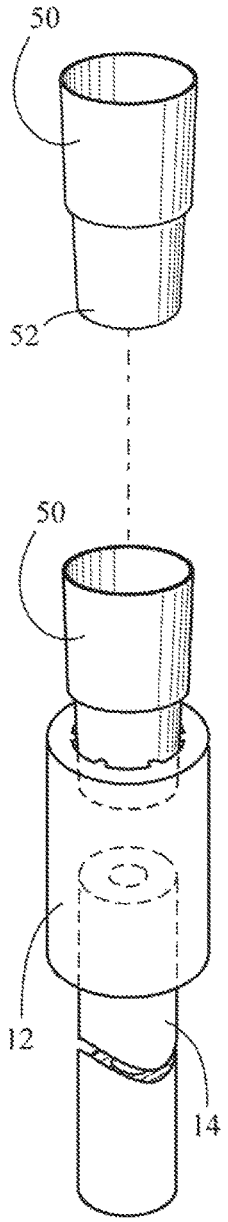
FIG. 8 depicts the insertion of a thermally insulated tumbler into the drink holder.

Referring now to FIG. 8, a typical 30 oz., stainless steel, thermally-insulated tumbler 50 is shown. The lower end 52 of the tumbler 50 is approximately 2.8 inches in diameter, which is greater than the small inner diameter 36 of the drink holder 12 as defined by the tips 32 of the ridges 30. The action of inserting the lower end 52 of the tumbler 42 into the drink holder 12 thus deforms, compresses, and/or crushes the ridges 30, creating a secure fit between the tumbler and the drink holder. The diameter of the lower end 52 of the tumbler 50 is less than the large inner diameter 34 of the drink holder 12 (i.e., 3.0 inches in the disclosed embodiment), permitting the lower end 52 of the tumbler 50 to fit into the central opening 22 of the drink holder by crushing or deforming the ridges 30 of the drink holder.

Figure 9:
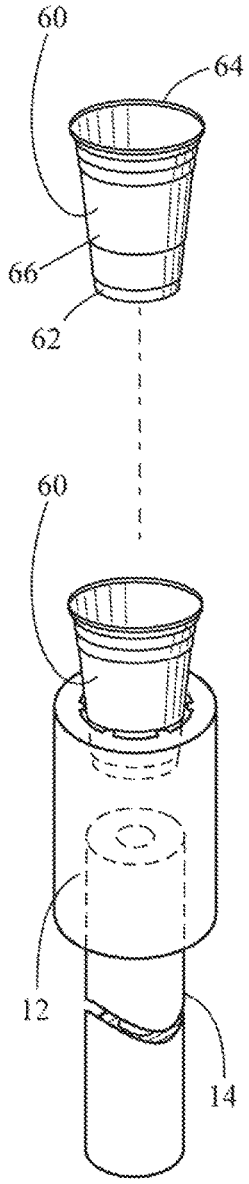
FIG. 9 depicts the insertion of a 16 oz, single-walled, plastic cup into the drink holder.

FIG. 9 depicts a 16 fl oz, single-walled, plastic cup 60, such as that sold by the Solo Cup Company, of Lake Forest, Ill. Such plastic cups are of well-known design and are about 4.75 in. tall and 2.5 in. in diameter at their lower end 62. The side wall of the cup tapers outward to a diameter of 3.75 in. at its upper end 64. The diameter of the plastic cup 60 at its lower end is the about the same as the small inner diameter 36 of the drink holder 12 as defined by the tips 32 of the ridges 30. Almost immediately above the base of the cup 60, however, the outward taper of the cup's side wall 66 presents a diameter greater than the small inner diameter 36 of the drink holder 12, such that further insertion of the cup into the drink holder deforms or crushes the ridges 30. The interference fit between the side wall 66 of the cup 60 and the ridges 30 of the drink holder 12 holds the cup in place and helps prevent it from tipping or accidentally becoming dislodged from the drink holder.

Figure 10:
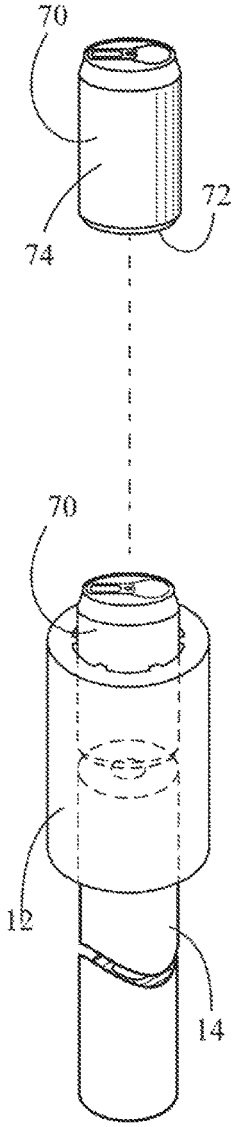
FIG. 10 depicts the insertion of a U.S. standard 12 oz, beverage can into the drink holder.

Looking now at FIG. 10, a U.S. standard, 12 fl oz can 70 is 2.05 inches in diameter at its base 72 and 2.60 inches in diameter at the widest part 74 of the cylindrical can body. Because the diameter of the base 72 (2.05 inches) is less than the smaller inner diameter 36 of the drink holder 12 defined by the tips 32 of the ridges 30 (i.e., 2.5 inches), the base 72 of the can 70 will fit into the drink holder without interference from the ridges. As the user pushes the can 70 into the drink holder 12, the widest part 74 of the can (2.6 inches, or 0.1 inches greater than the small inner diameter 36 of the drink holder 12) contacts the ridges 30. As the can 70 is pushed further into the drink holder 12, the side wall of the can deforms, compresses, or crushes the ridges 30 to create an interference fit that will hold the can firmly.

Figure 11:
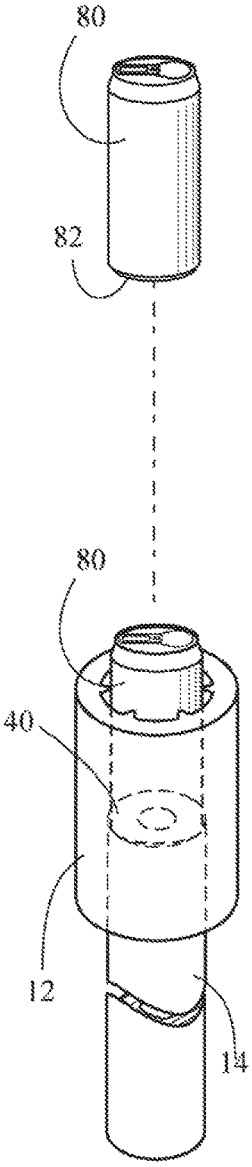
FIG. 11 depicts the insertion of a non-standard beverage can into the drink holder.

Referring to FIG. 11, non-standard cans 80, such as those often used for energy drinks and some beers, are about 6.5 inches tall and about 2.5 inches in diameter. Because the diameter of the non-standard can 80 is not larger at any point than the smaller inner diameter 36 of the drink holder 12, the drink can 80 does not crush or deform the ridges when it is placed in the drink holder 12. In such an instance, the bottom 82 of the can 80 simply rests on top of the end 40 of the noodle 14 that has been inserted into the opposite end of the drink holder 12. The clearance between the side wall 84 of the non-standard can 80 and the tips of the adjacent ridges 30 is sufficiently close that the drink holder 12 prevents the can from tipping.

It will be appreciated that the diameter of at least the lower portion of a drink container must be less than or equal to the large inner diameter 34 defined by the inner wall 26, for at least the lower end of the drink container to fit into the drink holder. But as seen by the example of the non-standard can 80, it is not essential that the diameter of the drink container be larger than the small inner diameter defined by the tips 32 of the ridges 30 for the drink container to be held and prevented from tipping over by the drink holder 12. The most secure fit between the drink container and the drink holder 12, however, occurs when the diameter of the drink container is sufficiently large to deform, compress, or crush the ridges 30.

As used herein, words such as top, bottom, left, right, horizontal, vertical, and the like are used with reference to the drawings for convenience of description. Unless stated otherwise, use of such words is not intended to limit the invention to any particular orientation.

Finally, it will be understood that the foregoing embodiments have been disclosed by way of example, and that other modifications may occur to those skilled in the art without departing from the scope and spirit of the appended claims.

What is claimed is:

1. An apparatus comprising a pool noodle, drink holder, and beverage container in combination, said pool noodle comprising an elongated cylinder of flexible, buoyant material, said cylinder having an outer diameter and opposing ends;

said drink holder comprising:

a tubular body having upper and lower ends, an outer wall, and an inner wall, said inner wall defining a first inner diameter; and a plurality of longitudinal, deformable ridges extending radially inward from the inner wall of said tubular body, each of said ridges terminating at a tip;

wherein when said ridges are in an undeformed state, said tips of said ridges define a second inner diameter smaller than said first inner diameter;

said beverage container having a lower end having an outer diameter;

wherein said outer diameter of said pool noodle and said outer diameter of said lower end of said beverage container are less than or equal to said first inner diameter of said drink holder;

wherein said outer diameter of said pool noodle is greater than or equal to said second inner diameter of said drink holder;

an end of said pool noodle being received within said lower end of said tubular body of said drink holder, said pool noodle deforming said ridges of said drink holder to create an interference fit that attaches said drink holder to said end of said pool noodle; and said lower end of said beverage container being received within said upper end of said tubular body of said drink holder, said lower end of said beverage container deforming said ridges of said drink holder to create an interference fit that removably attaches said beverage container to said drink holder.

2. The apparatus of claim 1, wherein said flexible, buoyant material from which said pool noodle is formed comprises foamed polyethylene.

3. The apparatus of claim 1, wherein said drink holder is comprised of foamed polyethylene.

4. The apparatus of claim 1, wherein said first inner diameter defined by said inner wall of the drink holder is from 2.75 to 4.0 inches.

5. The apparatus of claim 4, wherein said first inner diameter defined by said inner wall of the drink holder is 3.0 to 3.5 inches.

6. The apparatus of claim 1, wherein said second inner diameter defined by said tips of said ridges of said drink holder is from 2.0 inches to 2.75 inches.

7. The apparatus of claim 6, wherein said second inner diameter defined by said tips of said ridges of said drink holder is from 2.0 inches to 2.75 inches.

8. The apparatus of claim 1, wherein each of said ridges of said drink holder is 0.1 to 0.5 inches from base to tip.

9. The apparatus of claim 8, wherein each of said ridges of said drink holder is 0.25 inches from base to tip.

* * * * *